United States Patent [19]

Delfino

[11] 4,285,886

[45] Aug. 25, 1981

[54] CARBURETOR

[76] Inventor: Anthony T. Delfino, 2155 Bedevere Cir., #F, Decatur, Ga. 30035

[21] Appl. No.: 150,185

[22] Filed: May 15, 1980

[51] Int. Cl.[3] ..... F02M 21/04

[52] U.S. Cl. ..... 261/30; 48/144; 123/522; 261/52; 261/70; 261/124; 261/DIG. 74; 261/DIG. 83

[58] Field of Search ..... 123/522; 48/144; 261/52, 124, 70, 30, DIG. 74, DIG. 83

[56] References Cited

U.S. PATENT DOCUMENTS

| | | | |
|---|---|---|---|
| 673,365 | 4/1901 | Hopkins | 48/144 |
| 951,590 | 3/1910 | Brown | 48/144 |
| 1,222,106 | 4/1917 | Kelly et al. | 261/DIG. 83 |
| 1,504,642 | 8/1924 | Nelson | 261/DIG. 83 |
| 1,605,251 | 11/1926 | MacMillan | 261/DIG. 83 |
| 1,938,497 | 12/1933 | Pogue | 261/DIG. 83 |
| 2,229,452 | 1/1941 | Hammer et al. | 261/DIG. 83 |
| 2,658,489 | 11/1953 | Putt | 123/522 |
| 2,678,202 | 5/1954 | Brake | 261/DIG 83 |
| 2,742,886 | 4/1956 | McPherson | 261/DIG. 83 |
| 3,338,223 | 8/1967 | Williams | 123/522 |
| 4,011,847 | 3/1977 | Fortino | 123/522 |
| 4,175,525 | 11/1979 | Johnson | 123/522 |
| 4,177,779 | 12/1979 | Ogle | 123/522 |

*Primary Examiner*—Tim R. Miles

*Attorney, Agent, or Firm*—James B. Middleton

[57] ABSTRACT

A carburetor device for an internal combustion engine is disclosed. The device includes a well adjacent to the intake manifold for holding a quantity of liquid fuel. Perforated tubing is in the bottom of the well, and air under pressure is selectively supplied to the tubing to froth the liquid fuel and produce fuel vapor. The amount of the tubing receiving air under pressure is varied in accordance with fuel demand. The fuel vapor is mixed with ambient air and directed into the intake manifold. The system includes a storage tank for providing the air under pressure, and a pump to supply air to the storage tank.

10 Claims, 5 Drawing Figures

Fig. 1
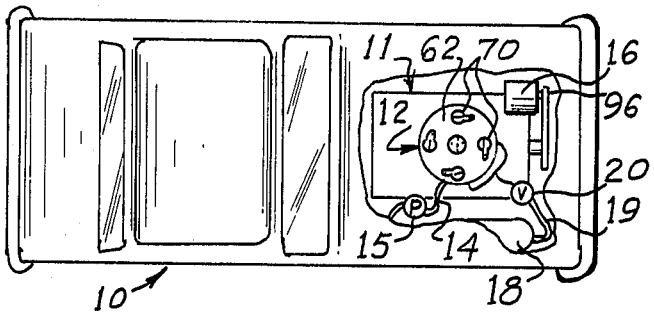
Fig. 2
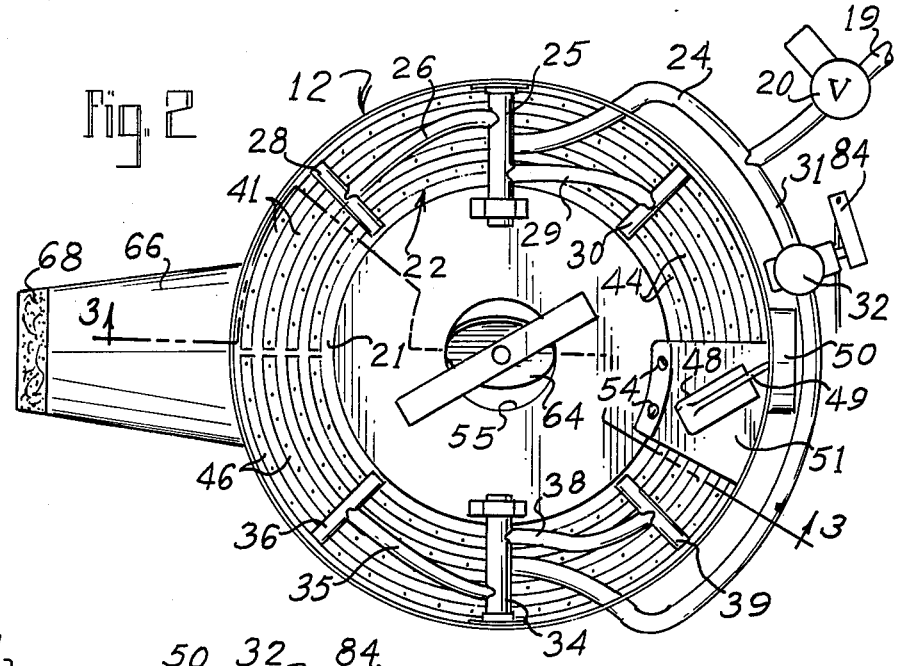
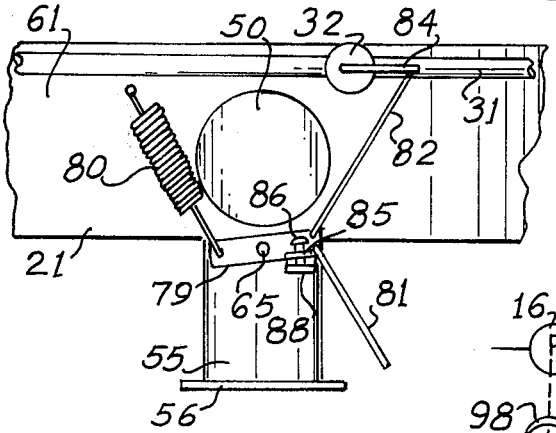
Fig. 4
Fig. 5
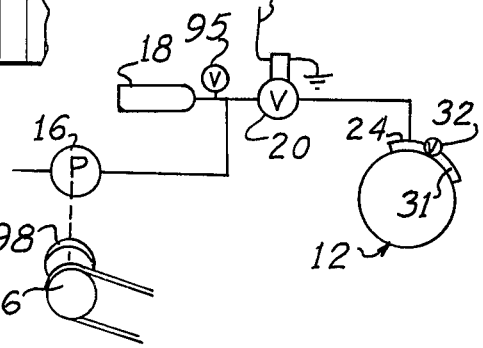

CARBURETOR

FIELD OF THE INVENTION

This invention relates generally to carburetion systems, and is more particularly concerned with a method and apparatus for the vaporization of liquid fuel for providing a fuel-air mixture to a combustion engine.

BACKGROUND OF THE INVENTION

Liquid fuel is most commonly used with internal combustion engines, and is likely to continue so because of the ease of handling, storage and the like. The use of liquid fuels requires that some means be provided for intimately admixing the liquid, in a finely divided state, with air to be placed into a cylinder of an engine for combustion.

Conventionally, carburetors have been used to provide the desired mixture of fuel and air, the conventional carburetor comprising, in general, means for spraying liquid fuel into a draft of air, and means for creating sufficient turbulence to cause the desired mixing of the atomized fuel with the air. Such an arrangement is difficult to control since liquid fuel is simply sprayed into a moving column of air, and the amount of the liquid to be sprayed at any given instant needs to be controlled in accordance with a large number of variables. The conventional carburetor therefore becomes increasingly complex as the liquid flow is made dependent on an increasing number of different conditions. Also, it will be recognized that, even though the liquid is sprayed in a fine mist, it is still a substantial liquid that is placed into the intake manifold, then into the cylinder of the combustion engine. There have been some efforts at providing means for vaporizing the liquid prior to placing the fuel into the cylinder, but these devices have been unduly complex, and have frequently been used in conjunction with a substantially conventional carburetor in an effort to obtain the required control over the internal combustion engine.

SUMMARY OF THE INVENTION

The present invention overcomes the above mentioned and other difficulties with the prior art by providing liquid fuel storage means adjacent to the intake manifold of an engine, and means for frothing the liquid fuel to create vapor therefrom. The liquid fuel storage and the vapor are within housing means immediately adjacent to the intake manifold; and, air inlet means are provided to allow air to pass from the outside, through the enclosure and into the intake manifold, carrying fuel vapor with it. Means are provided for varying the amount of frothing of the liquid fuel in accordance with different operating ranges of the engine, and a substantially conventional throttle valve is provided for engine variation within the ranges.

BRIEF DESCRIPTION OF THE DRAWINGS

These and other features and advantages of the present invention will become apparent from consideration of the following specification when taken in conjunction with the accompanying drawings in which:

FIG. 1 is top plan view of an automobile having an internal combustion engine with a carburetor device made in accordance with the present invention mounted thereon;

FIG. 2 is an enlarged top plan view, with the cover removed, showing the carburetor device of FIG. 1;

FIG. 3 is a cross-sectional view taken substantially along the line 3—3 in FIG. 2, and showing the cover in place;

FIG. 4 is a partial side elevational view of the embodiment shown in FIGS. 1, 2, and 3, showing the accelerator linkages; and, FIG. 5 is a schematic view showing one form of air supply means for use in a device made in accordance with the present invention.

DESCRIPTION OF THE PREFERRED EMBODIMENT

Figure 5:
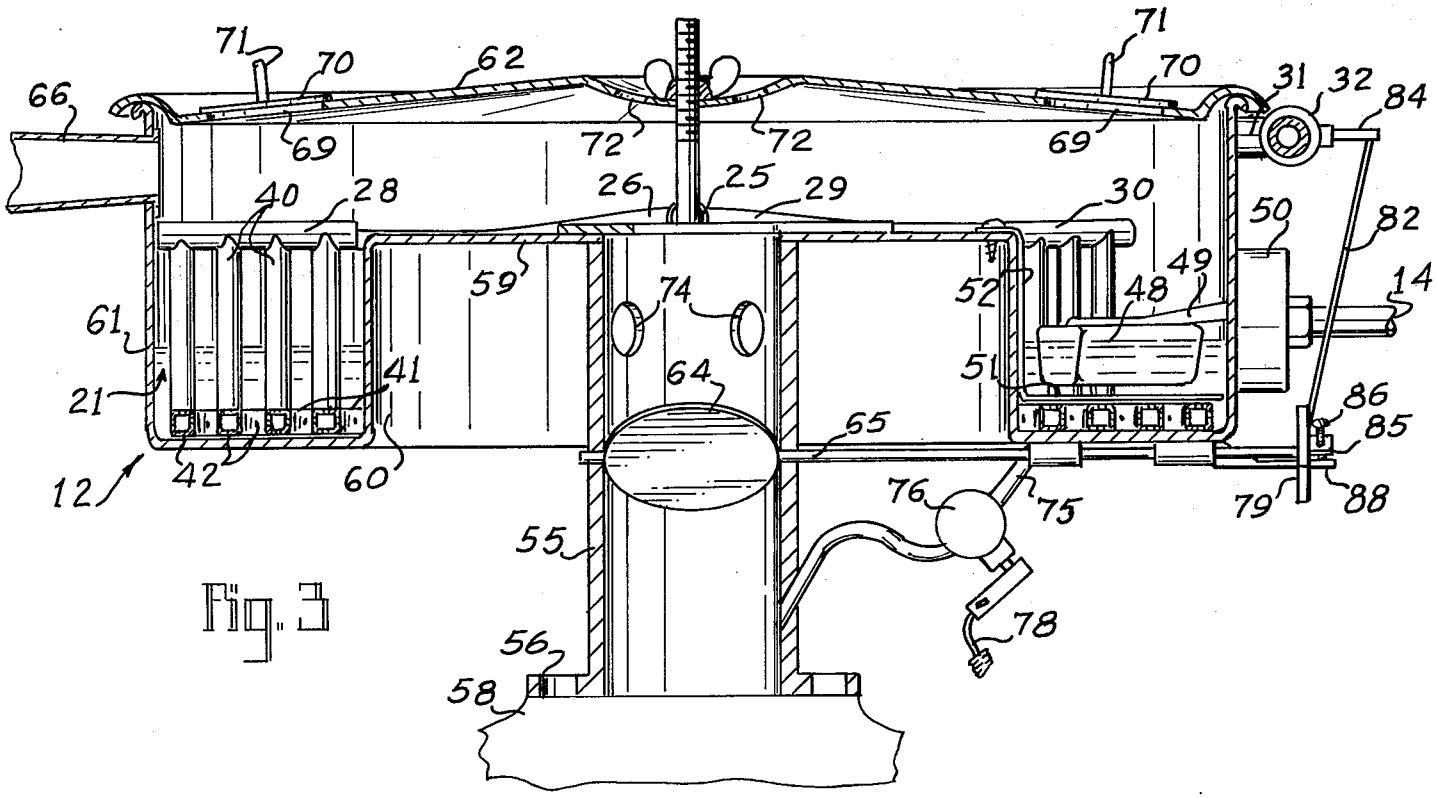

Referring now more particularly to the drawings, and to that embodiment of the invention here chosen by way of illustration, FIG. 1 shows a substantially conventional automobile generally designated at 10 having an internal combustion engine 11 therein. The carburetor device of the present invention is indicated at 12, and is mounted on the engine. A fuel line 14 is connected to the carburetor device 12, and the conventional fuel pump is indicated at 15. There is here shown, somewhat schematically, an air pump, or air compressor, designated at 16 which would be driven from the engine 11. The air pump 16 will provide the air necessary to operate the carburetor device 12; and, an air storage tank 18 is also provided with an air line 19 extending from the tank 18, through a valve 20 and to the carburetor device 12. This arrangement will be discussed in more detail hereinafter.

Attention is now directed to FIGS. 2 and 3 of the drawings for an understanding of the carburetor device 12. It will be seen that the carburetor device includes an annular well 21 for receiving a supply of liquid fuel. In the bottom of the well 21, there is a plurality of tubes generally indicated at 22. The tubes 22 are air-carrying tubes, and there are some of these tubes 22 distributed throughout the circumference of the annular well 21.

Looking primarily at FIG. 2 of the drawings, it will be seen that the valve 20 with the air supply line 19 is connected to a first supply tubing 24 which may also be designated as the low-speed supply tubing. The supply tubing 24 is connected to a header 25; and, from the header 25 there is a tube 26 connected to a manifold 28, and a tube 29 connected to a manifold 30.

There is also a second supply tubing 31 which is the high-speed supply tubing, and the tubing 31 is connected through a valve 32, and to a header 34. This arrangement is similar to the one just described, the header 34 having a tube 35 conncted thereto and to a manifold 36, and a second tube 38 connected to the header 34 and to a manifold 39.

The manifold 28 as shown in FIG. 3 of the drawings is typical of the arrangement used herein. In FIG. 3, it will be seen that the manifold 28 has a plurality of connectors 40 to connect the manifold 28 with a portion of the tubes 22.

Returning now to FIG. 2 of the drawings, it will be understood that the manifold 28 is supplied with air through the tube 26 from the header 25, and the manifold 28 supplies air to a first group of tubes 41, the tubes 41 extending around an arc of the annular well 21. It will be seen that each of the tubes 41 is generally square, though the precise shape is not critical to the present invention. On each of the four sides, the tubes 41 are provided with a series of holes, or air nozzles, 42, and the ends of the tubes 41 are closed by crimping, capping or the like.

Similarly, the manifold 30 is connected to a group of tubes 44 which extend approximately to the tubes 41 in one direction, and approximately to a group of tubes 45 in the opposite direction. The entire arrangement with the manifold 30 and the tubes 44 is the same as the manifold 28 with its tubes 41. It will therefore be seen that air from the supply tubing 24 is supplied to the header 25, from there to the manifolds 28 and 30 so that air from the supply tubing 24 is supplied to perforated tubings 41 and 44 extending perhaps somewhat more than half the circumference of the annular well 21.

Considering now the manifold 39, it will be understood that the manifold 39 has connectors somewhat similar to the conductors 40 to connect the manifold 39 to the tubes 45, the tubes 45 extending approximately to the header 34. The manifold 36 has connectors to connect the manifold 36 to a group of tubes 46, the tubes 46 extending generally from the header 34 to the ends of the tubes 41.

As will be further understood hereinafter, it is necessary that a given level of liquid fuel be provided within the well 21. To maintain the desired level, there is a level control means, here shown as a conventional float and valve arrangement. The float is indicated at 48 and there is an arm 49 which extends from a valve housing 50. The float valve is well known to those skilled in the art, and no further description is thought to be necessary to an understanding of such a level control means as used in the present invention.

It will be observed that there is a shield 51 between the tubes 45 and the float 48. The shield 51 is here shown as a piece of sheet metal conforming to a small section of the well 21, and fixed in place by an upstanding portion 52 having screws 54 or other fastening means for retaining the shield 51 in place.

From the foregoing it should now be understood that air will be admitted through the line 19 through the valve 20 and to the first supply tube 24. From the low-speed tube 24, air will be provided through the header 25 and manifolds 28 and 30 to be distributed by the tubes 41 and 44. Liquid fuel will have been supplied to the well 21 through the tube 14 and through the float valve so that a level of liquid fuel is maintained within the well 21. Due to the fact that air is passed through the perforate tubes 41 and 44 beneath the surface of the liquid fuel within the well 21, it will be understood that the liquid fuel will be frothed, causing a vaporization of the liquid fuel. It is contemplated that the air supply through the low-speed line 24 will provide a sufficient quantity of vaporized fuel to supply the engine 11 for idling speed and through the low ranges of speed.

When a higher speed is desired so that a greater quantity of vaporized fuel is required, the valve 32 will be opened so that the high-speed tubing 31 will also provide air to the header 34 from which the manifolds 36 and 39 receive air to be distributed throughout the tubes 45 and 46. Then, it will be seen that air is bubbling through the fuel substantially throughout the area of the well 21.

It will be understood that this vigorous bubbling of air through the liquid fuel would normally impinge on the float 48, causing the float to rise and cut off the float valve to terminate the flow of fuel. This would give a false reading of the liquid level so that the supply of liquid may be completely exhausted. The shield 51 prevents this false reading by blocking the air flow in the vicinity of the float 48. While the shield 51 is here shown as a physical baffle for blocking the air flow that causes false readings by the float 48, those skilled in the art will understand that other forms of shielding may be used equally well. For example, the perforated tubing could simply be terminated at each side of the float 48; or, the particular tubes, such as the tubes 45, could be imperforate in the vicinty of the float 48. The shield as shown, however, provides a very simple and ecomonical means for blocking the air flow without requiring other changes.

Those skilled in the art will realize that, in order to operate an internal combustion engine, the vaporized fuel generated in the well 21 must be collected, mixed with additional air, and placed into the intake manifold of the engine. The structure for achieving this result is best shown in FIG. 3 where it will be seen that the carburetor device 12 includes a central, cylindrical column 55 which has a lower mounting flange 56 to be received by the intake manifold, the manifold being shown fragmentarily at 58.

The upper end of the column 55 mounts a disk 59, the periphery of the disk 59 supporting a cylindrical wall 60 which is the inner wall of the annular well 21. An outer wall 61 is parallel to the inner wall 60, the wall 61 extending above the disk 59. Due to this arrangement, the cover 62 is supported by the upper edge of the outer wall 61, and there remains a space between the disk 59 and the cover 62.

It will be seen that the column 55 is open at the top so that the interior of the column 55 communicates with the space within the housing. Thus, fuel vapor generated within the well 21 can pass across the disk 59, confined by the outer wall 61 and the cover 62, and the fuel vapor will pass downwardly through the column 55 and into the intake manifold 58. As is conventional, the carburetor is provided with a throttle valve 64 having an operating shaft 65, the shaft 65 being selectively rotatable by depression of the accelerator pedal as will be discussed in more detail hereinafter.

To provide the air to be mixed with the fuel vapor within the carburetor device 12, it will be seen that there is the conventional air inlet 66, the inlet 66 being here shown as provided with a filter 68 to filter the incoming air.

It should be noted in FIG. 3 of the drawings, that the air inlet 66 has its opening through the wall 61 well above the liquid level within the well 21. While there may be a tendency for some of the froth to rise approximately to the level of the opening into the air inlet 66, it will be understood that, while the engine is operating, there will be a draft through the housing of the carburetor device so that air will tend to enter the inlet 66 and move towards the central column 55. As a result, it is unlikely that any fuel will escape through the air inlet 66 or other air inlets to be described.

As shown somewhat in FIG. 1 of the drawings, and also shown in FIG. 3, the cover 62 is provided with a plurality of selectively openable ports 69. Each of the ports 69 has a closure 70 which is pivoted with respect to the cover 62. A handle 71 may be provided on the closure 70 for manipulating the closures to vary the opening of the ports 69.

As here shown, there are four of the ports 69 located 90 degrees apart, and generally on the periphery of the cover 62. One can therefore open each of the ports somewhat to allow a balance of air flow, or one or more of the ports 69 may be opened to provide any desired air flow.

Generally centrally of the cover 62, there are additional holes 72. It will be noted that the holes 72 are substantially aligned with the column 55 so that air can pass through the opening 72 and almost directly into the throat of the carburetor. If desired, the holes indicated at 74 may also be provided within the column 55. While air passing through the holes 72 will entrain very little fuel vapor, the air passing through the holes 74 will be unable to entrain any fuel vapor so that use of the holes 72 and 74 will be primarily to render the fuel mixture more lean.

When the engine is turned off and there is no longer a draft through the carburetor device 12, it will be understood that there will also be no froth because the valve 20 will be closed. Vapor remaining within the device may tend to escape through the openings 69, 72 and 74; however, it will be understood that much of the vapor will be heavier than air and will not float from the device. Also, filter material such as the filter 68 over the opening 66 may be used, or numerous forms of valves such as flap valves or the like may be used to close the various openings when the engine is not operating.

The carburetor of the present invention will operate satisfactorily as shown, and the addition of filters, valves or the like would be for the purpose of meeting anti-polution standards rather than to make the carburetor operate more effectively.

Also shown best in FIG. 3 of the drawings, there is a choke line 75 connected to the bottom of the well 21 and communicating therewith so that the line 75 will receive liquid fuel from the well 21. The line 75 is provided with a valve 76 operable by a bowden wire 78, the line passing from the valve 76 directly into the column 55 below the throttle valve 64. It should be obvious that when the valve 76 is open, liquid fuel will flow through the line 75 into the column 55 to make the fuel-air mixture richer.

Looking at FIG. 4 of the drawings, the outer end of the throttle valve shaft 65 has a lever 79 fixed thereto. One end of the lever 79 receives one end of a return spring 80, the opposite end of the spring 80 being affixed to the wall 61 by an appropriate hook or the like. The spring 80 attempts to contract to rotate the lever 79 in a clockwise direction as shown in the drawing, which is the appropriate direction to close the throttle valve 64. On the opposite end of the lever 79, there is shown a link 81 which is connected to the accelerator pedal. When the accelerator pedal is depressed, the link 81 will be moved upward to exert a counterclockwise force on the lever 79 to attempt to rotate the shaft 65 and open the throttle valve 64. Also, a connecting link 82 extends from the lever 79 to the operating arm 84 of the valve 32.

The lever 79 is provided with a tab 85 which threadedly receives a screw 86, the lower end of the screw 86 bearing against a fixed bracket 88. It will therefore be seen that the screw 86 can be rotated to cause the lever 79 to rotate in a counterclockwise direction, and the screw 86 with the bracket 88 provides a stop in a clockwise direction for the lever 79.

From the foregoing description, the operation of the device should now be understandable. Assuming there is air in the storage cylinder 18, in order to start the engine, one would turn on the ignition switch which would provide a voltage on the wire 90 in FIG. 6 to energize the solenoid for the valve 20, thereby opening the valve 20. This will allow air to flow from the cylinder 18 into the carburetor device 12. Air will then pass through the first supply line 24 and to the header 25, thence to the manifolds 28 and 30 so that air will bubble through the liquid fuel within the well 21. This frothing of the fuel will cause vaporization of the fuel so that fuel vapor will be available within the carburetor device 12. It will be understood that since air under pressure is introduced beneath the surface of the liquid, and preferably towards the bottom of the liquid, all components of the liquid will be frothed so that heavier components will not be left behind. The engine will be rotated by means of the conventional starter motor so that a vacuum is drawn within the intake manifold 58. This vacuum will be reflected into the column 55 so that the fuel vapor will be drawn from the carburetor device 12 into the column 55, thence into the intake manifold 58. Those skilled in the art will realize that the position of the throttle valve 64 will determine the quantity of fuel-air mixture to be taken into the intake manifold, and it will be seen that the position of the throttle valve 64 is determined by motion of the link 81 which rotates the lever 79.

It will be understood that the tubes 41 and 44 will provide a given quantity of fuel vapor because of the amount of frothing of the fuel, and the amount produced by these tubes will be sufficient for idling and relatively low speeds of the engine. When greater speed is demanded, additional fuel vapor will required. For this reason, as the accelerator link 81 is moved further, the connecting link 82 will move the operating arm 84 to open the valve 32 to bring the manifolds 36 and 39 into play and cause air to pass through the tubes 46 and 45. Thus, there will be additional frothing of the fuel, hence additional vaporization of the fuel and a greater quantity of fuel vapor available for the engine.

There are numerous means for supplying the air required in starting the engine. One possibility is to provide an electrically operated air pump to be operated from the battery when starting the automobile. As here illustrated, it is contemplated that the storage cylinder 18 will always have sufficient air to provide the initial fuel vaporization for starting the engine; however, in the event there is no air in the cylinder 18 the bowden wire 78 can be manipulated to allow liquid fuel to flow through the line 75 and into the intake manifold. Once the engine starts, the pump 16 will provide additional air to maintain the device.

As shown in FIG. 5, the cylinder 18 is provided with a pressure relief valve 95 simply as a safety valve to keep from exceeding the rated capacity of the cylinder 18. As shown very schematically, the pulley 96 which drives the pump 16 may be connected to a clutch 98. With such an arrangement, when the cylinder 18 is full, the clutch 98 will be disengaged to prevent further operation of the pump 16. The clutch 98 may be an electrically operated clutch responsive to a pressure switch in the cylinder 18, or it may be simply a torque responsive clutch so that the clutch 98 will slip when the back pressure against the pump 16 reaches a predetermined pressure. These and other variations will be obvious to those skilled in the art.

Though the well 21 is here shown as annular, it should also be obvious that other shapes are within the scope of the present invention. Also, it will be understood that, while the arrangement wherein the column 55 is centrally of the device is a simple and efficient arrangement, the invention equally contemplates other arrangements so long as the well 21 remains sufficiently close to the intake manifold that the remaining features of the invention can be realized.

It will therefore be understood by those skilled in the art that the partcular embodiment of the invention here presented is by way of illustration only, and is meant to be in no way restrictive; therefore, numerous changes and modifications may be made, and the full use of equivalents resorted to, without departing from the spirit or scope of the invention as defined in the appended claims.

I claim:

1. A carburetor device, for use with an internal combustion engine having an intake manifold from which at least one cylinder receives a fuel-air mixture, said carburetor device comprising a well for holding a quantity of liquid fuel, level control means for maintaining a predetermined level of liquid fuel within said well, a first plurality of tube means beneath said predetermined level of liquid fuel in a first portion of said well, a second plurality of tube means beneath said predetermined level of liquid fuel in a second portion of said well, a source of air pressure connected to both said first plurality of tube means and said second plurality of tube means, accelerator valve means between said source of air under pressure and said second plurality of tube means, passage means through which said well communicates with said intake manifold, a throttle valve within said passage means, and connecting means for selectively operating said accelerator valve in response to operation of said throttle valve.

2. A carburetor device as claimed in claim 1, said carburetor device further including a first manifold for distributing air from said source of air under pressure to each tube of said first plurality of tube means, said first plurality of tube means comprising perforate tubes for releasing air below said level of liquid fuel.

3. A carburetor device as claimed in claim 2, said carburetor device further including a second manifold for distributing air from said source of air under pressure to each tube of said second plurality of tube means, said second plurality of tube means comprising perforate tubes for releasing air below said level of liquid fuel.

4. A carburetor device as claimed in claim 3, and including a cover for said well for defining an enclosure for said carburetor device, air inlet means in said cover for admitting ambient air into said enclosure, and wherein said passage means through which said well communicates with said intake manifold is fixed to and is in communication with said enclosure.

5. A carburetor device as claimed in claim 4, said passage means through which said well communicates with said intake manifold comprising a generally cylindrical column having a first end fixed to said enclosure and a second end fixed to said intake manifold, said well being closely adjacent to said intake manifold.

6. A carburetor device as claimed in claim 5, said well being generally annular in configuration and surrounding said column, said level of liquid fuel being below said first end of said column and above said second end of said column, said carburetor device further including a choke line comprising a choke tube having one end in communication with said well and the opposite end in communication with said passage means through which said well communicates with said intake manifold, a valve in said choke tube for selectively allowing fuel flow through said choke tube, and means for operating said valve.

7. A carburetor device as claimed in claim 2, said level control means including a float for detecting said predetermined level, and further including shield means to shield said float from air released below the liquid level.

8. A carburetor device as claimed in claim 4, and including closure means for selectively opening at least one of said inlet means in said cover.

9. A carburetor device as claimed in claim 6, said source of air under pressure including a storage tank for air under pressure, a supply line connected to said storage tank, a low-speed tubing connecting said supply line to said first plurality of tube means, a valve in said supply line for selectively allowing air flow from said storage tank, and pump means for supplying air to said storage tank.

10. A carburetor device as claimed in claim 9, and including a high-speed tubing connecting said supply line to said second plurality of tube means, said accelerator valve being in said high-speed tubing.

* * * * *